US006824132B2

(12) United States Patent
Asai et al.

(10) Patent No.: US 6,824,132 B2
(45) Date of Patent: Nov. 30, 2004

(54) SHEET FEEDING APPARATUS AND RECORDING APPARATUS

(75) Inventors: Yasuyuki Asai, Kawasaki (JP); Tadashi Hanabusa, Kawasaki (JP); Shinya Sonoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/137,376

(22) Filed: May 3, 2002

(65) Prior Publication Data

US 2002/0171193 A1 Nov. 21, 2002

(30) Foreign Application Priority Data

May 10, 2001 (JP) ..... 2001/139980
May 10, 2001 (JP) ..... 2001/139981

(51) Int. Cl.[7] ..... B65H 3/52

(52) U.S. Cl. ..... 271/125; 271/124; 271/121; 271/117; 271/273; 271/274

(58) Field of Search ..... 271/117, 121, 271/124, 125, 256, 114, 10.09, 273, 274

(56) References Cited

U.S. PATENT DOCUMENTS 4,928,951 A * 5/1990 Fukui ..... 271/113
5,470,052 A * 11/1995 Asakawa et al. ..... 271/118
5,655,762 A 8/1997 Yergenson ..... 271/121
5,725,208 A * 3/1998 Miyauchi ..... 271/10.09
5,997,198 A 12/1999 Murayama et al. ..... 400/624
6,059,281 A 5/2000 Nakamura et al. ..... 271/119
6,082,729 A * 7/2000 Padget ..... 271/121
6,331,002 B1 12/2001 Yoshino et al. ..... 271/117
6,382,621 B1 * 5/2002 Inoue et al. ..... 271/120
6,382,857 B1 5/2002 Yanagi et al. ..... 400/636
6,467,767 B2 * 10/2002 Yano ..... 271/122
6,547,237 B2 * 4/2003 Sugino et al. ..... 271/119

FOREIGN PATENT DOCUMENTS

JP 03-256944 11/1991
JP 04164723 A * 6/1992 ..... B65H/1/04
JP 10-167502 6/1998
JP 10-333372 12/1998
JP 2000-143023 5/2000

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

A sheet material feeding device includes a sheet material stacking means for stacking sheet materials; a feeding roller for feeding the sheet material stacked on the sheet material stacking means; a separation roller, driven by the feeding roller, for separating a sheet material from the sheet materials; a separation roller holder for rotatably holding the separation roller, the separation roller holder is movable by rotation thereof between a position in which the separation roller is contacted to the feeding roller and a position in which the separation roller is away from the feeding roller; and returning means for returning a sheet material or sheet materials other than the sheet material separated out by the separation roller to the sheet material stacking means.

16 Claims, 10 Drawing Sheets

SHEET FEEDING APPARATUS AND RECORDING APPARATUS

FIELD OF THE INVENTION AND RELATED ART

The present invention relates to a sheet material feeding device for feeding a sheet material or a plurality of sheet materials one by one. The materials may be recording materials, copying materials, original documents or the like fed to a recording station, copying station, reading station or the like in a recording apparatus, an image forming apparatus, an image reading apparatus or the like such as a printer, a copying machine, a printing apparatus, a facsimile machine, a scanner or the like, and also relates to a recording apparatus using the same.

Such a sheet material feeding device is equipped with a double feed preventing mechanism to prevent two or more sheets from being fed simultaneously to assure separation of sheets for one-by-one feeding of the sheets.

Known sheet material feeding devices with the double feed preventing mechanism include a retarding roller type which uses a roller reversely rotated with respect to the sheet feeding direction through a torque limiter, a returning lever type which uses a returning lever which is operated each time a predetermined number of the sheets are fed to return the leading end of the sheet material to a predetermined position, and a type in which these two types are combined.

One of the examples of the returning type is disclosed in U.S. Pat. No. 5,997,198, in which a feeding roller is rotated in the sheet material feeding direction through a driving source for the sheet material feeding device, and after the feeding operation is completed by one full-rotation of the feeding roller, the driving source is rotated in the opposite direction to actuate the returning lever to returns the leading end of the sheet material to a predetermined position.

An example of the combination type is disclosed in Japanese Laid-open Patent Application Hei 10-167502 in which when a stacking means for stacking the sheet materials is urged in a releasing direction of releasing the contact of the stacked sheet material to the feeding roller, a retarding roller which is rotated in the opposite direction (opposite to the feeding direction) through a torque limiter is separated. Substantially simultaneously, the returning lever is actuated to returns the leading end of the sheet material to a predetermined position.

However, in such conventional examples, some limitations are imposed to actuate the mechanism for preventing the double feeding of the sheet materials.

More particularly, in the sheet material feeding device using the retarding roller, the use is made with the torque limiter for which a releasing torque has to be maintained at a proper level, and the roller has to be reversely rotated at all times during the feeding operation. These requirements make the mechanism complicated, bulky and expensive. In addition, the returning lever has to be actuated only after completion of the series of the feeding operations, and therefore, an additional time is required for the returning lever operation with the result of longer time required for the double feeding prevention.

SUMMARY OF THE INVENTION

Accordingly, it is a principal object of the present invention to provide a sheet material feeding device and a recording apparatus wherein the double feeding of the sheet materials are assuredly prevented with a simple structure not leading to bulkiness or expensiveness of the apparatus, and which does not require a complicated control or long time for the double feeding prevention.

According to an aspect of the present invention, there is provided a sheet material feeding device comprising a sheet material stacking means for stacking sheet materials; a feeding roller for feeding the sheet material stacked on said sheet material stacking means; a separation roller, driven by said feeding roller, for separating a sheet material from said sheet materials; a separation roller holder for rotatably holding said separation roller, said separation roller holder is movable by rotation thereof between a position in which said separation roller is contacted to said feeding roller and a position in which said separation roller is away from said feeding roller; and returning means for returning a sheet material or sheet materials other than the sheet material separated out by said separation roller to said sheet material stacking means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to their company and drawings, the preferred embodiments of the present invention will be described.

Figure 1:
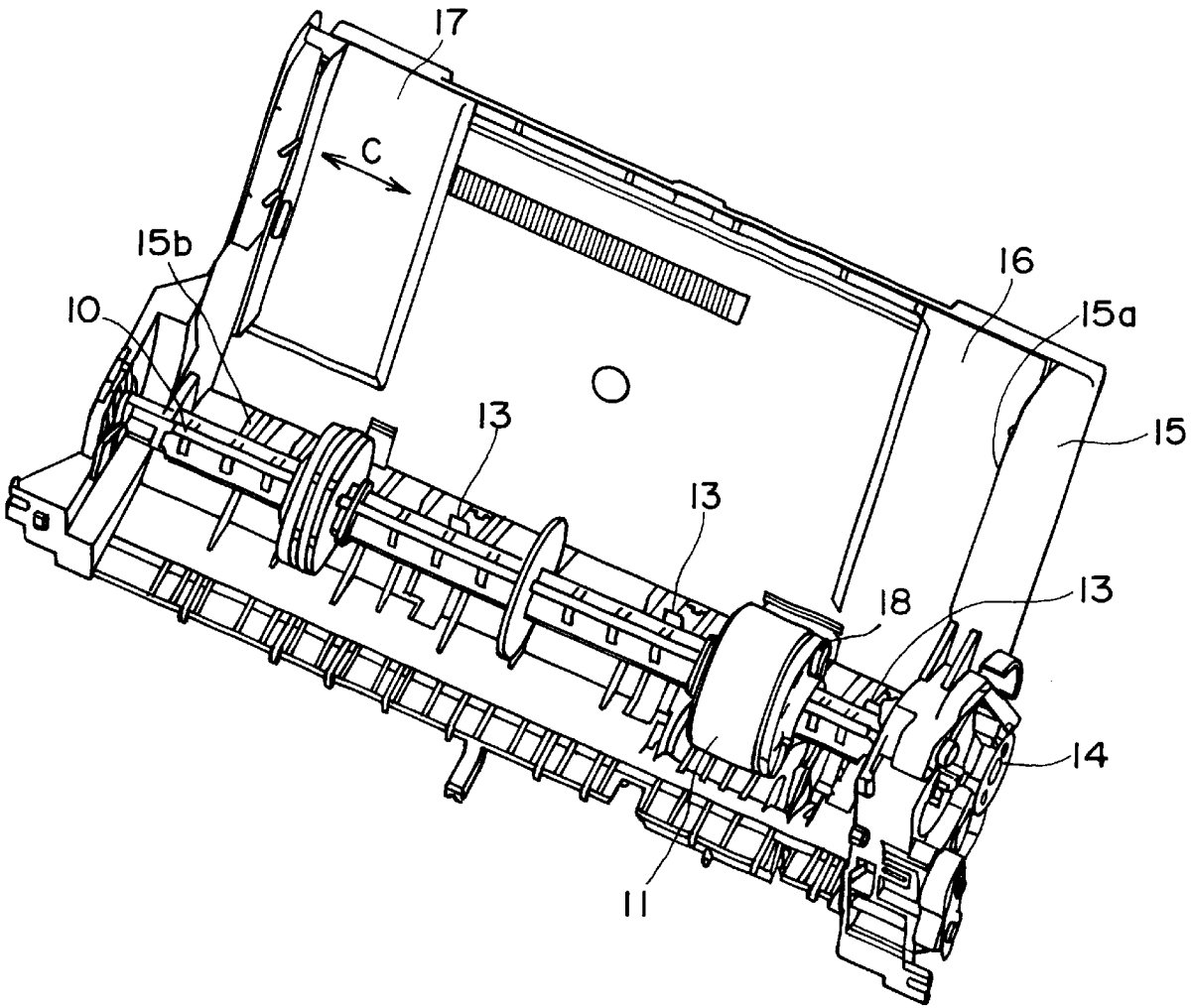
FIG. 1 is a schematic perspective view of a sheet material feeding device according to an embodiment of the present invention.
Figure 2:
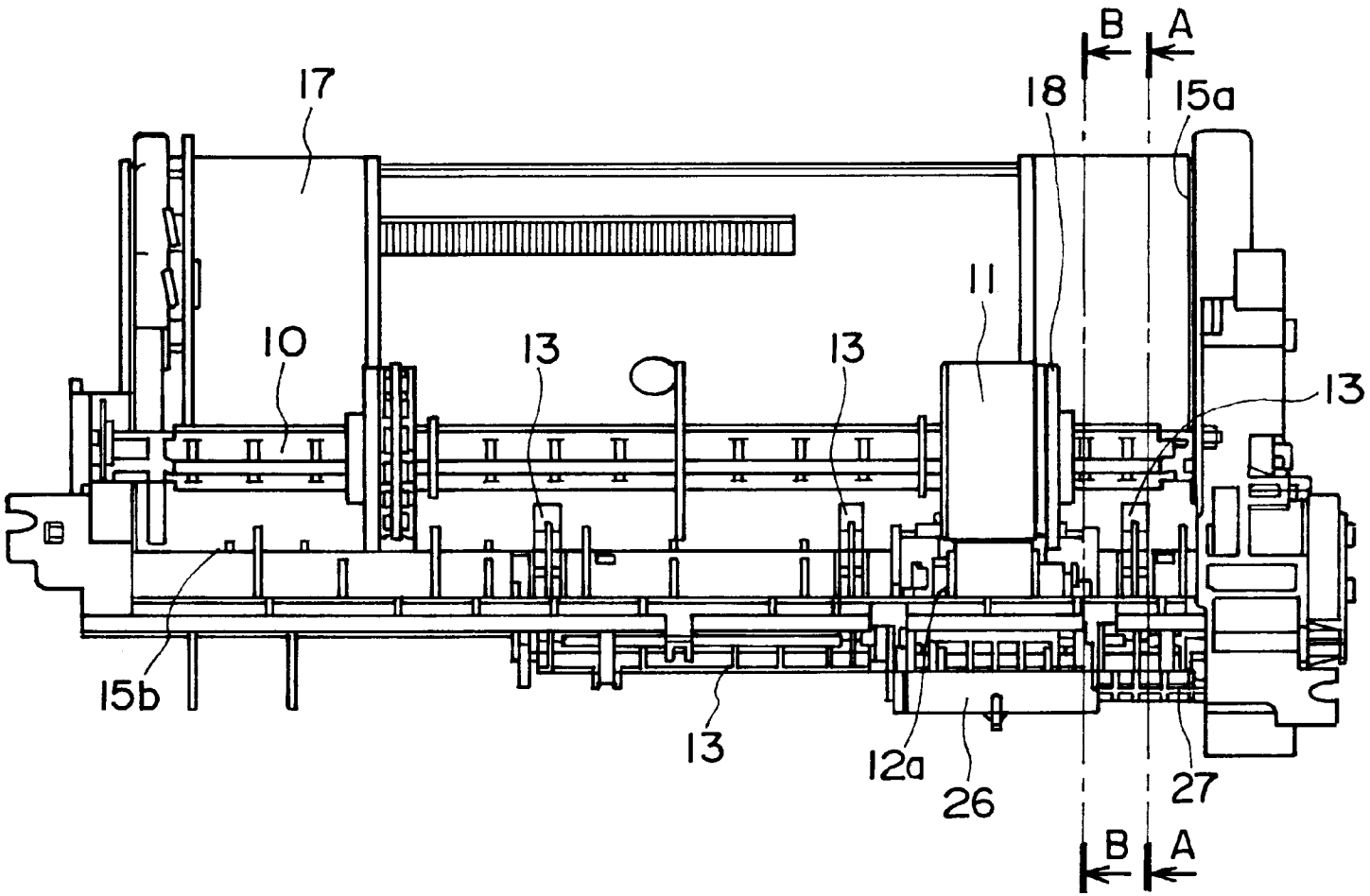
FIG. 2 is a schematic front view of a sheet material feeding device according to an embodiment of the present invention.
Figure 3:
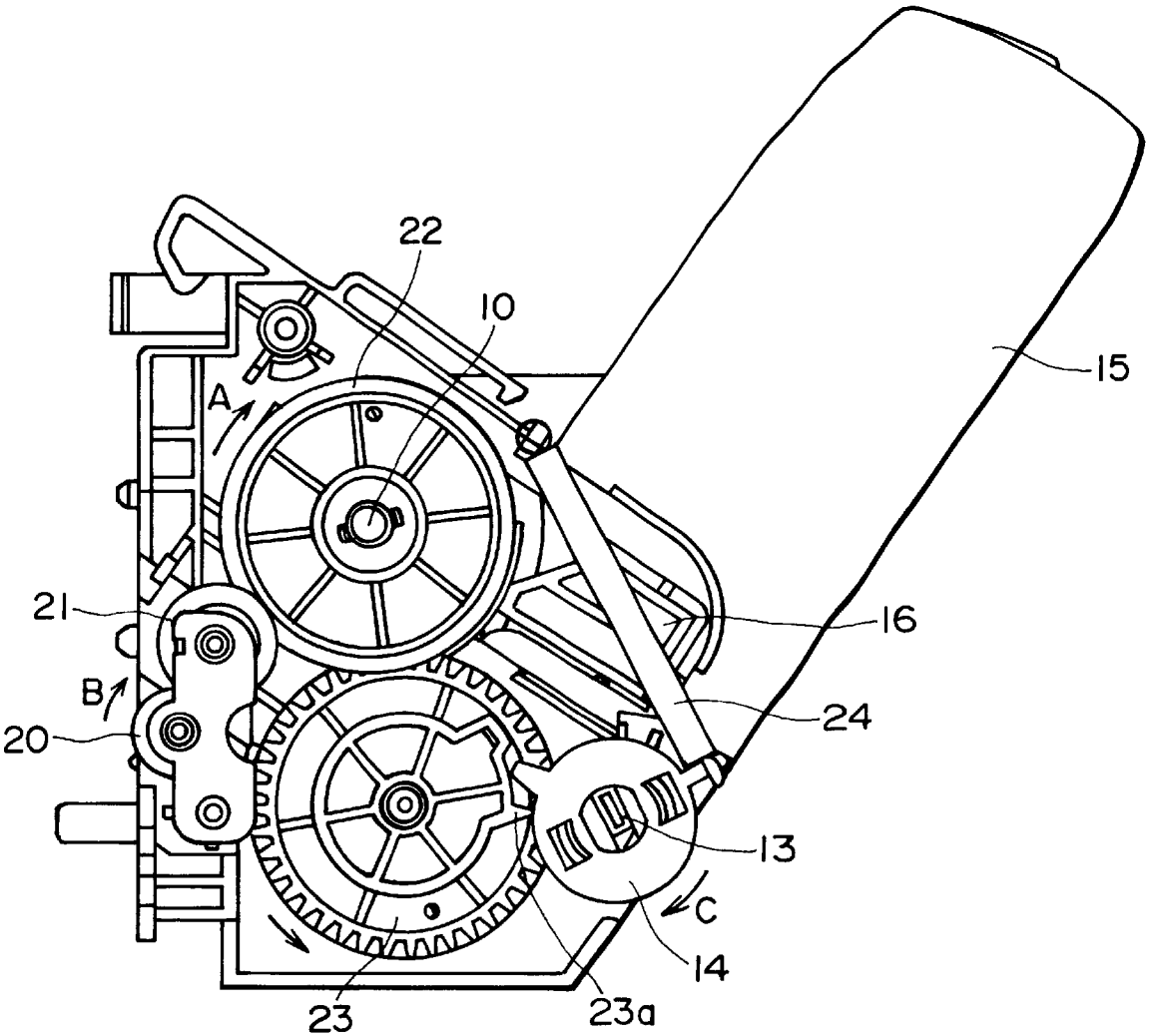
FIG. 3 is a schematic side view of a sheet material feeding device according to an embodiment of the present invention.
Figure 4:
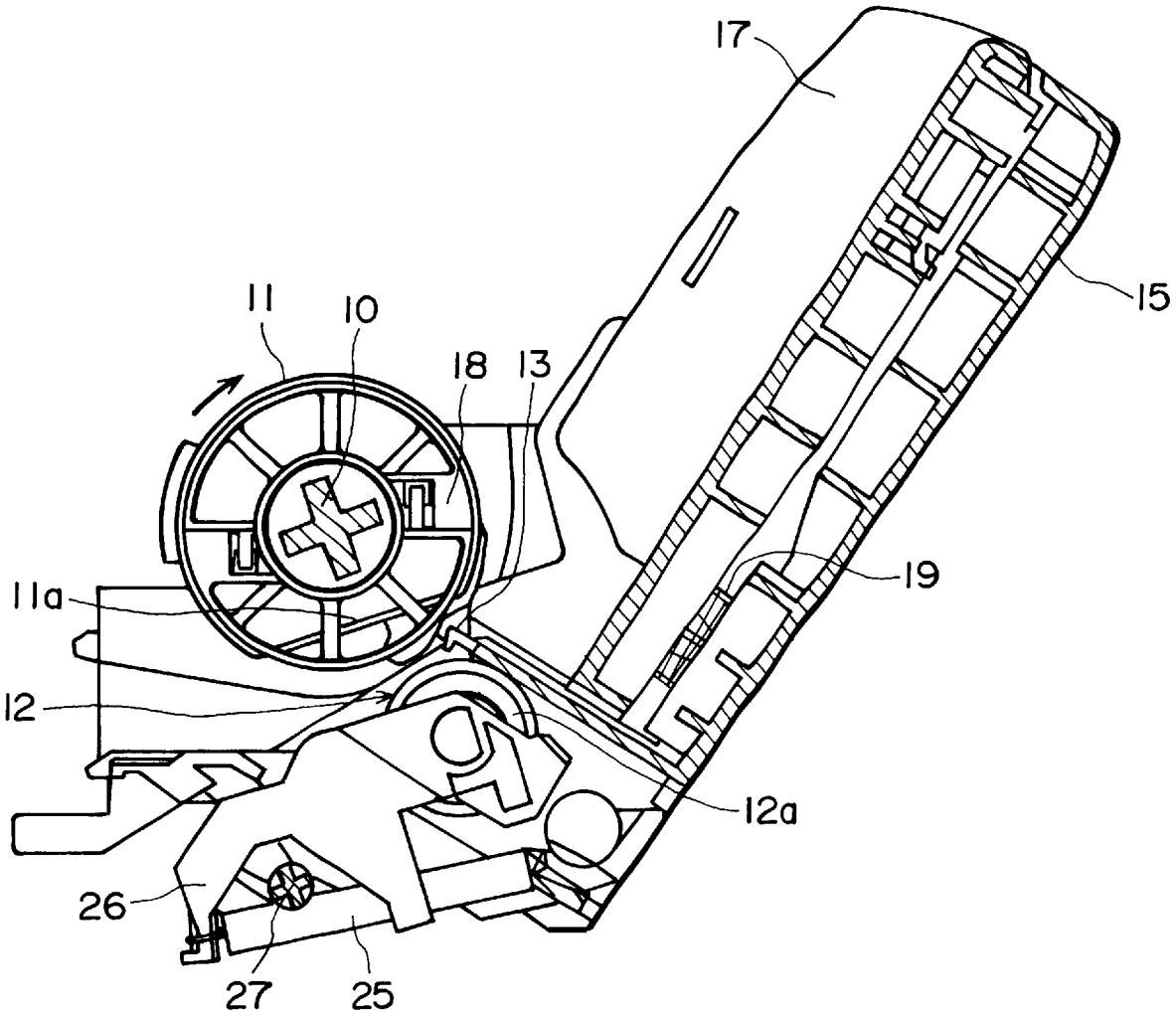
FIG. 4 is a schematic sectional side elevation of a sheet material feeding device according to an embodiment of the present invention.

FIG. 1 is a schematic perspective view of a sheet material feeding device according to an embodiment of the present invention; FIG. 2 is a schematic front view of the sheet material feeding device; FIG. 3 is a schematic side view of the sheet material feeding device; FIG. 4 is a schematic sectional side elevation of the sheet material feeding device.

Referring to FIGS. 1 to 4, the sheet material feeding device (automatic sheet feeder (ASF) ) according to this embodiment comprises a feeding roller 11 (a single rotational feeding member) for feeding a sheet material (example a plurality of sheets) such as recording material, copying material, original or the like, a feeding shaft 10 for supporting and rotating the feeding roller 11, a separation roller 12 having a torque limiter 12*a* for separation of the sheet material, a returning lever 13 for sheet material double feeding prevention, a returning lever control cam 14 for actuating the returning lever 13, an ASF base 15 constituting a frame of the sheet material feeding device, a pressure plate 16 for stacking the sheet material and for urging them to the feeding roller 11, a side guide 17 for positioning the sheet material in a direction crossing with a feeding direction of the sheet material, and a feeding roller 18 for preventing contact of the sheet material to the feeding roller 11.

The sheet material feeding device of this embodiment is intended to be used with a recording apparatus, an image forming apparatus, image reading apparatus or the like such as a printer, a copying machine, a printing apparatus, a facsimile machine, a scanner or the like, and is not equipped with a driving source by itself, although the present invention is not limited to such a case. The sheet material feeding device is a driven device which is driven by the recording apparatus side (main assembly) through drive transmission. The sheet material feeding device of this invention is suitably usable with a recording apparatus having a recording means of an ink jet type which prints information on a recording sheet by ejecting ink to a sheet material through nozzles.

The sheet material feeding device of this embodiment generally comprises a sheet material stacking portion, a sheet feeding and separation portion and a double feed preventing portion.

(Sheet Material Stacking Portion)

The sheet material stacking portion includes a sheet material feeding reference portion 15*a* providing a sheet positioning reference for correctly positioning a lateral edges of the sheet material in a direction crossing with the sheet material feeding direction, the sheet material feeding reference portion 15*a* being formed projected from a part of the ASF base 15. The sheet material stacking portion further includes a pressure plate 16 and a side guide 17 for regulating a lateral edges opposite the sheet material feeding reference portion 15*a*. In a so-called stand-by state in which the sheet material feeding device is not in operation, the pressure plate 16 is fixed at a predetermined position away from the feeding roller 11, and in the state, a gap sufficient to stack a plurality of sheet material is provided between the feeding roller 11 and the processor. The sheet material feeding device is usable with any sizes of sheet materials within a predetermined width range. A plurality of the sheet materials are stacked in the gap along the sheet material feeding reference portion 15*a*. Then, the side guide 17 is moved in a direction indicated by an arrow C in FIG. 1 to align with the width of the sheet materials. By doing so, the stack of the sheet materials on the sheet material stacking portion is limited in the movement in the direction crossing with the sheet material feeding direction, so that stabilized sheet feeding is assured. The side guide 17 is slidably supported on the pressure plate 16, but it can be fixed by engaged with a latch groove formed in the pressure plate 16 to prevent unintended movement. Therefore, when the side guide 17 is to be moved, a lever portion provided on the side guide 17 is manipulated to release the latch, and then the side guide 17 is moved. The stacked sheet materials are at the lowest position by the gravity, the leading ends (bottom ends) thereof are abutted to the leading end reference portion 15*b* fixed on the ASF base 15. A stacking angle of the sheet materials on the ASF base 15 is preferably 30°–90° relative to a horizontal plane from the standpoint of stabilized feeding of the sheet material. In this embodiment, in order to reduce the load during the sheet material feeding operations, the leading end reference portion 15*b* is provided with ribs.

The pressure plate 16 has a center of rotation adjacent its top end, and is pivotable about the center. The rotational portion thereof is controlled by a spring and a cam. More particularly, it is normally rotationally urged toward the feeding roller 11 by a pressure plate spring 19, and a cam provided on a feeding shaft gear 22 which will be described hereinafter presses the pressure plate 16 to forcedly rotate the pressure plate 16 away from the feeding roller 11. The movement toward and away from the pressure plate is carried out at predetermined timing during the sheet material feeding operation.

(Feeding and Separation Portion)

The pressure plate is operated at predetermined timing so that stack of the sheet materials stacked on the sheet material stacking portion is pressed against the feeding roller 11. Together with the pressing, the feeding roller 11 is rotated by which the top most sheet material of the speck of the sheet materials that is contacted to the feeding roller 11 is fed through the frictional force relative to the feeding roller 11. Since the feeding roller 11 uses the frictional force for the feeding operation, it is preferably made of or coated with a rubber or urethane foam material or the like such as EPDM (ethylene propylene diene copolymer) which has a hardness of 20°–40° (A-scale) and which has a friction coefficient higher than that of the sheet material.

Referring to FIGS. 3 and 4, the description will be made as to a driving mechanism for the feeding and separation portion.

The driving mechanism for the feeding and separation portion comprises an ASF input gear 20 for receiving a driving force from a main assembly side gear, an ASF double gear 21 engaging with the ASF input gear 20 for transmitting the driving force to the next stage, a feeding shaft gear 22, fixed on the feeding shaft 10, for drive transmission, an ASF control gear 23 for controlling the returning lever 13 and the separation roller 12 having the torque limiter 12*a*, a returning lever spring 24 for urging in one direction a relative position of the returning lever controlling cam 14 and the returning lever 13, a separation roller urging spring 25 for urging the separation roller 12 having the torque limiter 12*a* toward the feeding roller 11, and a separation roller holder 26 rotatable LY supporting the separation roller 12 having the torque limiter 12*a*.

The driving force transmitted from the main assembly side gear rotates the ASF input gear 20 in a direction indicated by an arrow B in FIG. 3. The driving force is transmitted to the feeding shaft gear 22 through the ASF double gear 21 having a reducing function, and therefore, rotates the feeding shaft gear 22 in the direction indicated by an arrow An in FIG. 3. The driving force is transmitted to the ASF control gear 23. Since the feeding shaft gear 22 and the ASF control gear 23 are in meshing engagement with each other with a reduction ratio of 1:1, they are rotated with synchronized angular phases at all times. On one side of the ASF control gear 23, a cam 23*a* is formed which is always contacted by a cam follower portion of the returning lever controlling cam 14 urged by the returning lever spring 24, so that returning lever control cam 14 is driven in synchronized with the feeding shaft 10. In addition, an unshown cam is formed on the opposite side (opposite the side having the cam 23*a*) of the ASF control gear 23. By the unshown cam, a separation roller control cam 27 which will be described hereinafter is actuated to control the position of the separation roller 12 of the having of the torque limiter 12*a* in synchronism with the feeding shaft 10. In other words, the separation roller 12 having the torque limiter 12*a* is rotatably supported on the separation roller holder 26, and the separation roller holder 26 per se is supported for rotation about an unshown center of rotation. The separation roller 12 having the torque limiter 12*a* is urged toward the feeding roller 11 by the function of the separation roller urging spring 25. At a predetermined timing which will be described hereinafter, the urging action is released to move the separation roller 12 having the torque limiter 12*a* away from the feeding roller 11 by the drive control by the above-described separation roller control cam 27.

The foregoing is the description of the structures of the driving mechanism for the feeding and separating portion. The description will be made further as to the structure of the feeding and separation portion, referring to FIGS. 1–4.

The feeding roller 11 feeds the topmost sheet material of the stack of the sheet materials. In this case, fundamentally, only the topmost sheet material is fed out, since in most cases the frictional force between the feeding roller 11 and the topmost sheet material is larger than the frictional force between the topmost sheet material and the next sheet material. However, due to the flash at the edge of the sheet material occurring at the time of cutting the sheet materials, sticking of the sheet materials because of the static electricity or due to very high friction coefficient of the surfaces of the sheet materials, two or more sheet materials might be fed out simultaneously by the feeding roller 11. If this occurs, only the topmost sheet material is singled out according to the embodiment of the present invention. The separation roller 12 having the torque limiter 12*a* is press-contacted to the feeding roller 11 such that it is contacted to the feeding roller 11 at a position downstream of the initial contact point between the feeding roller 11 and the sheet material. The separation roller 12 per se having the torque limiter 12*a* is simply supported for rotation on the separation roller holder 26, but does not actively rotates.

Figure 9:
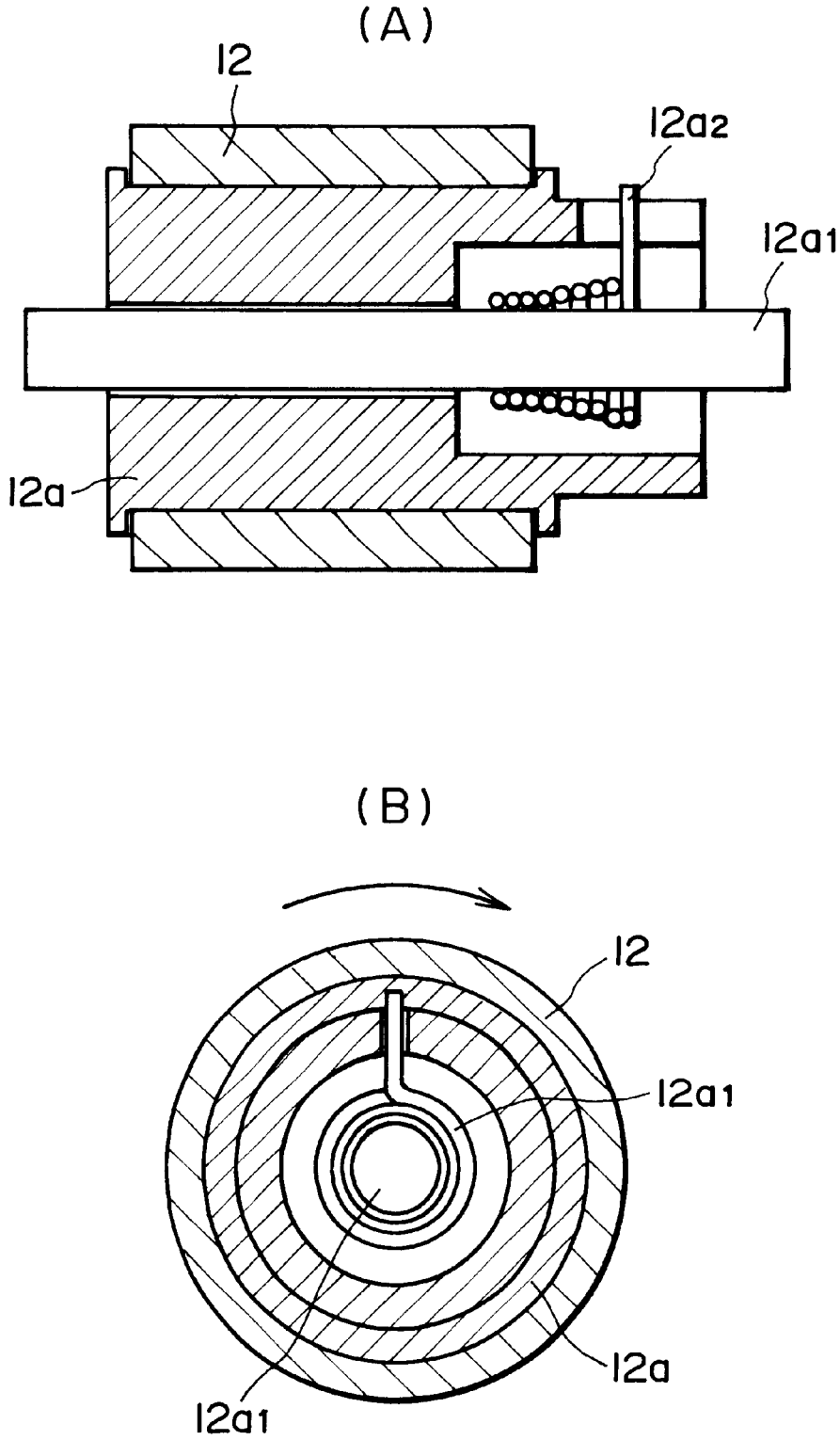
FIG. 9 is a schematic sectional side elevation illustrating a structure of a torque limiter used in a sheet material feeding device according to an embodiment of the present invention.

However, the fixed supporting shaft 12*a*1 of the separation roller 12 having the torque limiter 12*a* is fixed on the separation roller holder 26, and a metal or plastic resin material coil spring 12*a*2 is placed between the fixed supporting shaft 12*a*1 and separation roller 12 having the torque limiter 12*a*. In the beginning, the coil spring 12*a*2 tightens on the fixed supporting shaft 12*a*1, but when the separation roller 12 rotates through a predetermined angle, the coil spring 12*a*2 becomes loose on the fixed supporting shaft 12*a*1. Then, the coil spring 12*a*2 and the fixed supporting shaft 12*a*1 are slidable relative to each other. In this manner, a predetermined torque required for rotation of the separation roller 12 is maintained (FIG. 9 which is a sectional view illustrating the structure of the separation roller 12 having the torque limiter 12*a*; in this Figure, the coil spring 12*a*2 is loose on the fixed supporting shaft 12*a*1).

In addition, the separation roller 12 is made of or coated with rubber or urethane foam material such as EPDM (ethylene propylene diene copolymer) which has a hardness of approx. 20°–40° (A-scale) and which has a high friction coefficient, such that it has a friction coefficient equivalent to that of the feeding roller 11.

With this structure, when there is no sheet material between the feeding roller 11 and the separation roller 12 having the torque limiter 12*a*, the separation roller 12 having the torque limiter 12*a* is passively rotated with the rotation of feeding roller 11.

When one sheet material enters between the feeding roller 11 and separation roller 12 having the torque limiter 12*a*, the sheet material is fed by the feeding roller 11 while passively rotating the separation roller 12 having the torque limiter 12*a* because the frictional force between the feeding roller 11 and the sheet material is higher than the frictional force between the separation roller 12 following with the predetermined torque determined by the separation roller 12 having the torque limiter 12*a*.

However, in the case that two or more sheet materials enter between the feeding roller 11 and the separation roller 12 having the torque limiter 12*a*, the frictional force between the feeding roller 11 and the sheet material closer to the feeding roller is larger than the frictional force between the sheet materials, and similarly, the frictional force between the sheet material closer to the separation roller and the separation roller 12 having the torque limiter 12*a* is larger than the frictional force between the sheet materials, and therefore, the torque limiter function force of the separation roller 12 overcomes the frictional force between the sheet materials with the result of sliding between the sheet materials. As a result, only the sheet material closer to the feeding roller 11 is fed, but the sheet material closer to the separation roller 12 is not fed.

Figure 10:
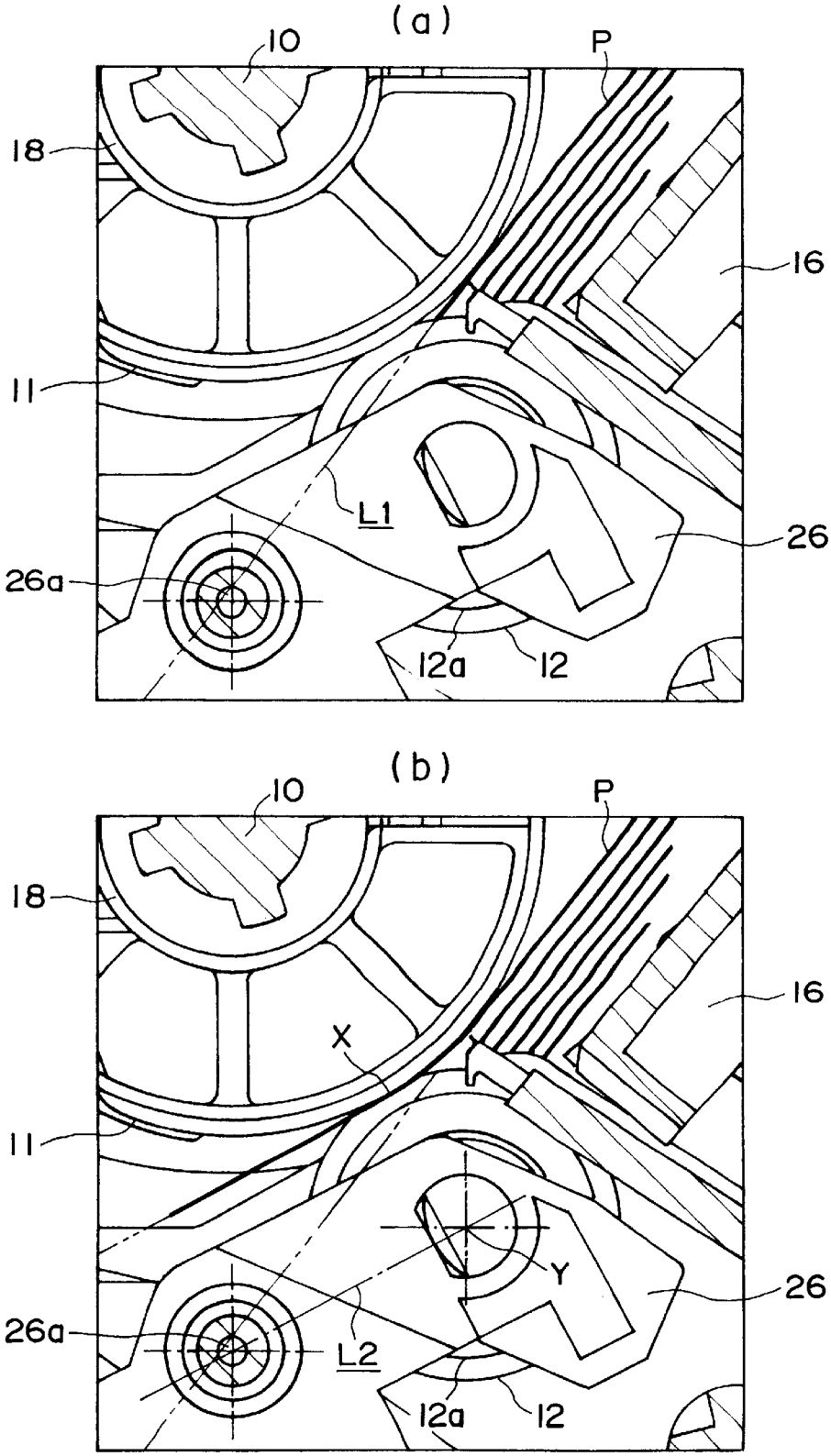
FIG. 10 is an enlarged schematic sectional side elevation showing a sheet feeding and separating portions of the embodiment of the present invention.

In the sheet material feeding device called this embodiment, the separation roller 12 is press-contacted to the feeding roller 11 at a position downstream, with respect to the sheet feeding direction, of a position at which the sheet material is first contacted into the feeding roller 11 by the pressure provided by the pressure plate 16. Therefore, as shown in FIG. 10(*a*), when the leading edge of the topmost sheet material fed by the rotation of the feeding roller 11 advances along a straight line while the separation roller 12 is in press-contact to the feeding roller 11, the leading edge abuts the outer periphery of the separation roller 26. The sheet material abutted to the outer periphery of the separation roller 12 is fed to the nip formed between the feeding roller 11 and the separation roller 12 as shown in (b) of FIG. 10 by the rotation of the separation roller 12 passively rotating with the feeding roller 11.

The center of rotation 26*a* of the separation roller holder 26 is adjacent an extension line L1 of an orbit of the leading-edge of the sheet material toward the outer periphery of the separation roller 26 as shown in (a) and (b) of FIG. 10. Therefore, even if the sheet material abuts the outer periphery of the separation roller 12, the force imparted from the sheet material to the separation roller 12 is not so strong in the direction of rotating the separation roller holder 26, so that contact pressure of the feeding roller 11 to the separation roller 12 is not significantly reduced. Thus, the separation roller 12 is passively rotated by the feeding roller 11 until the sheet material enters the nip so that sheet material is smoothly fed into the nip.

The center of rotation 26*a* of the separation roller holder 26 is substantially on a line L2 passing through the rotational axis Y of the separation roller 12 and parallel to a tangent line of the feeding roller 11 passing through the nip X formed between the feeding roller 11 and the separation roller 12 as shown in (b) of FIG. 10. Therefore, there is no rotating force in the direction of the separation roller holder 26 biting into the feeding roller 11. Therefore, despite the advancing direction of the sheet material changes at the nip, the separation roller 12 is pressed against the feeding roller 11 with a stabilized urging force.

In the foregoing, the description has been made as to the separation portion using the separation roller 12 having the torque limiter 12*a*.

(Double Feed Preventing Portion)

As described hereinbefore, even if two chic materials enter the nip between the feeding roller 11 and the separation roller 12 (having the torque limiter 12*a*) contacted into the feeding roller 11. However, if more chic materials or if after only one of the two chic materials are fed out with the other chic materials left adjacent the nip, the next sheet comes, there still is a possibility that dual feeding occurs. In order to prevent such dual feeding, the double feed preventing portion is provided.

The double feed preventing portion is constituted by the returning lever control cam 14 and the returning lever 13 in the driving mechanism for the feeding and separation portion. The returning lever controlling cam 14 is provided on one end of the returning lever 13 coaxially there with. The returning lever 13 is rotated by rotating the returning lever controlling cam 14 in the direction indicated by an arrow C in FIG. 3.

As described hereinbefore with respect to the structure of the driving mechanism for the feeding and separation portion, the returning lever 13 is actuating in synchronism with rotation of the ASF control gear 23. The fundamental operations thereof will be described. FIGS. 5–8 illustrate operations of the returning lever 13 during sheet material feeding operation.

Figure 5:
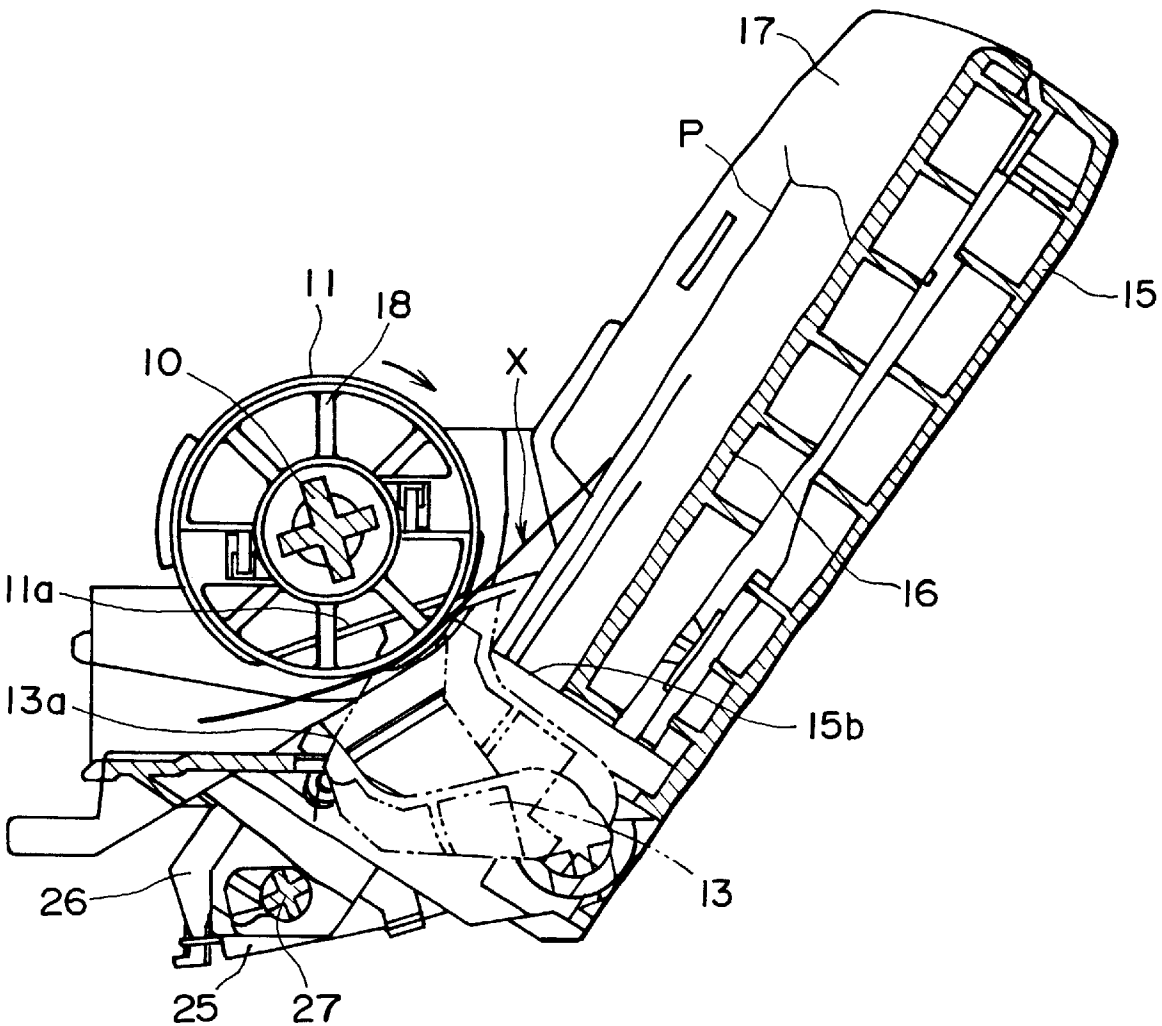
FIG. 5 is a schematic sectional side elevation illustrating operations of the sheet material feeding device according to the embodiment of the present invention.

As shown in FIGS. 4, 5, the feeding roller 11 has a D-shaped configuration as seen in a direction along the rotational axis thereof (a part of the outer surface of the cylindrical member is cut flat). After the leading end of the fed sheet material is caught by the main assembly side during one full turn of the feeding roller 11, the gap is formed by the cut surface 11*a* of the feeding roller 11 faces to the separation roller 12 having the torque limiter. That is, the latter part of the sheet material passes between the feeding roller 11 and separation roller 12 without contact to the roller surface of the feeding roller 11. Since the entire sheet material feeding path is bent generally into L-shape, the sheet material P tends to be wrapped around the roller surface of the feeding roller 11 due to the rigidity of the sheet material. Therefore, without any means, the sheet material is contacted to the feeding roller 11 having a roller surface with high friction coefficient, and therefore, a large friction load (back tension) is produced against the feeding force of the feeding means (unshown) provided in the main assembly. In order to prevent this, a feeding roller 18 which has a low friction coefficient and which is easily driven is provided on the feeding shaft 10 adjacent the feeding roller 11. By doing so, after the sheet material which is being fed is caught by the main assembly, a phantom line tangential to the feeding roller 18 is a sheet material feeding path X (thick line in FIG. 5).

Figure 6:
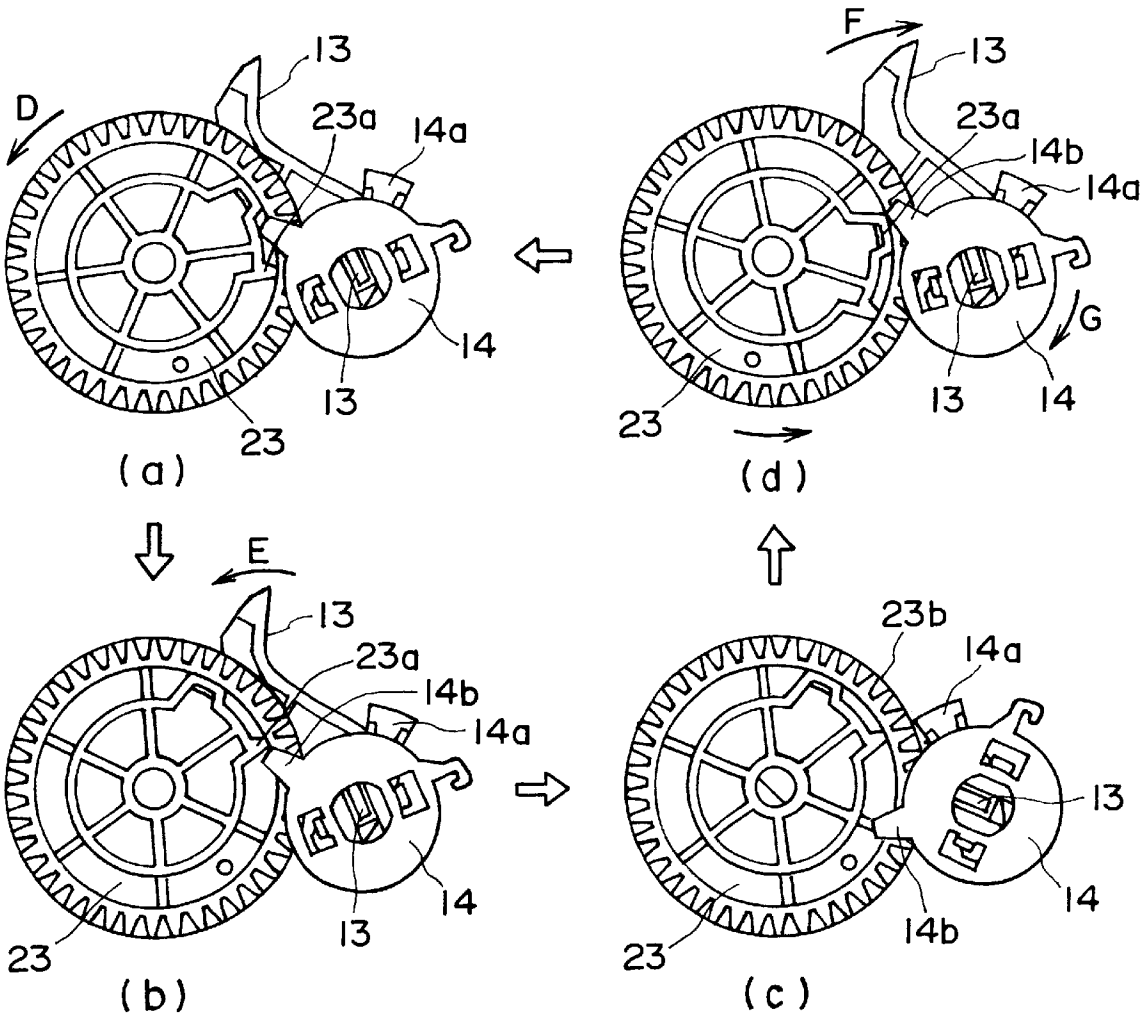
FIG. 6 is a partial schematic sectional side elevation illustrating operations of the sheet material feeding device according to the embodiment of the present invention.
Figure 7:
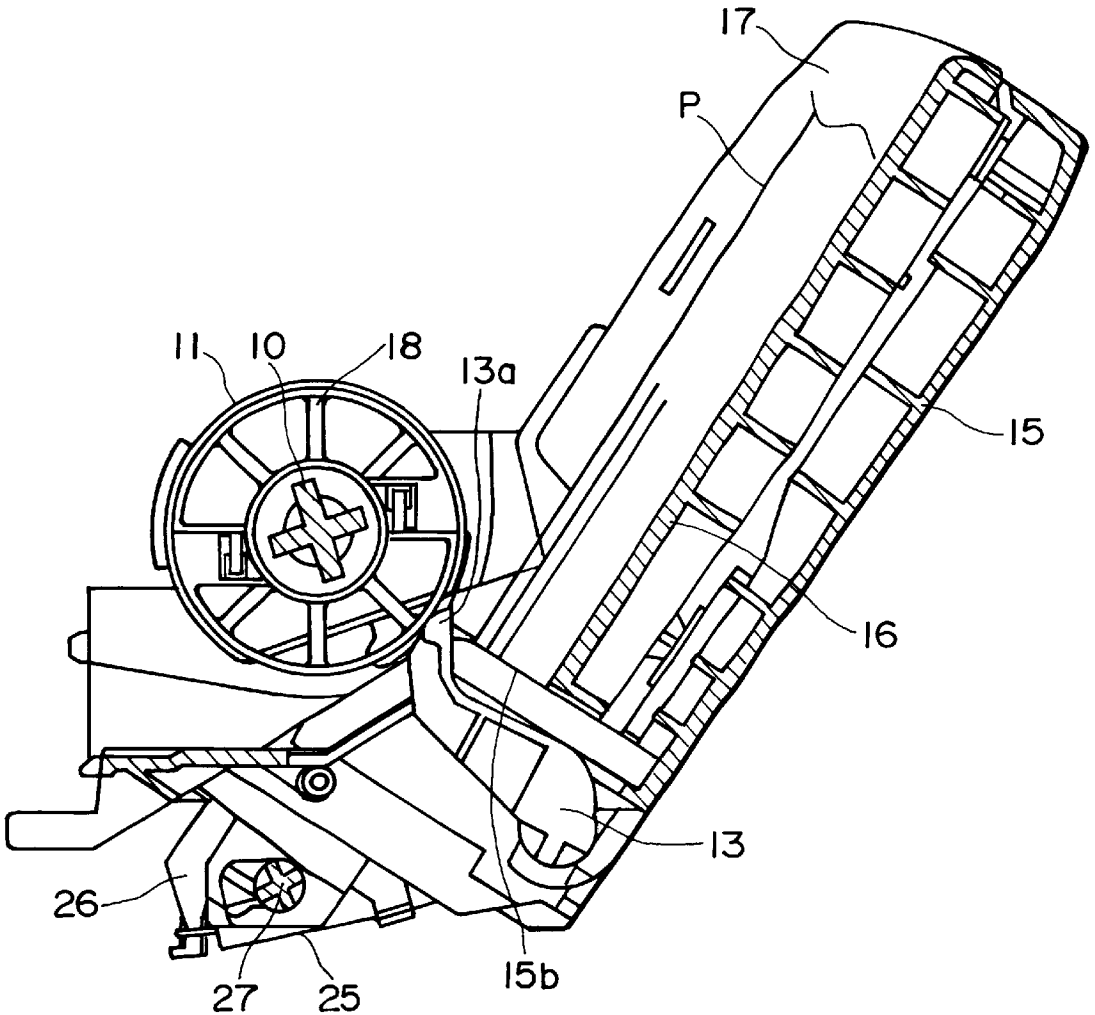
FIG. 7 is a schematic sectional side elevation illustrating operations of the sheet material feeding device according to the embodiment of the present invention.
Figure 8:
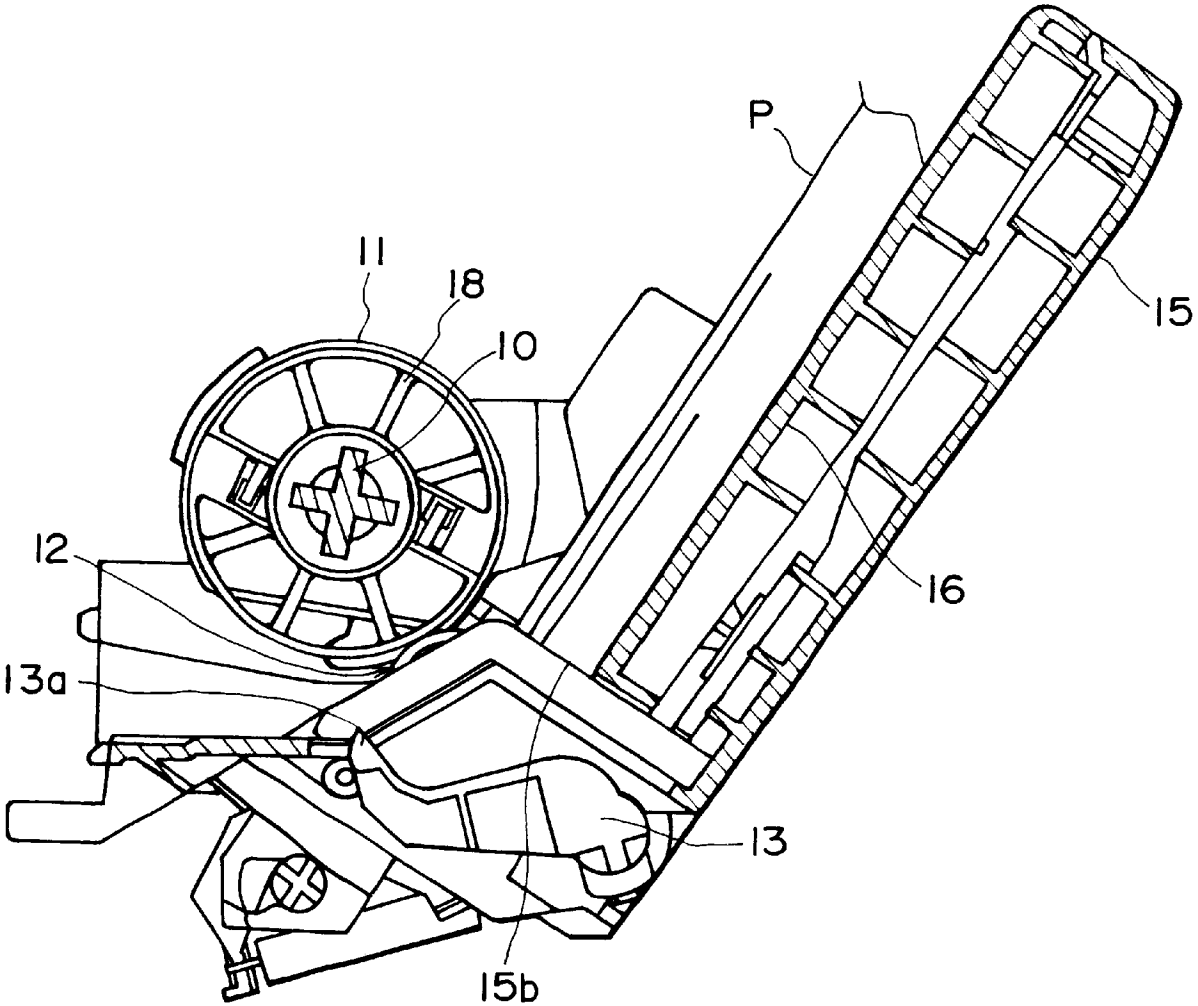
FIG. 8 is a schematic sectional side elevation illustrating operations of the sheet material feeding device according to the embodiment of the present invention.

The description will be made as to the operation of the returning lever 13 in synchronism with one full turn of the feeding roller 11. FIG. 6 is a side view forge illustration of the drive timing of the returning lever 13. FIG. 7 shows the general arrangement when the device is in the feeding stand-by state as shown in (a) of FIG. 6. With the state, the feeding operation starts. Then, with the rotation of the ASF control gear 23 in the direction of an arrow D in (a) of FIG. 6 in synchronism with rotation of the feeding shaft 10 of the feeding roller, the cam follower portion 14*b* of the returning lever controlling cam 14 is disengaged from the cam 23*a* of the ASF control gear 23 ((b) of FIG. 6). The returning lever 13 integral with the returning lever control cam 14 rotates in the sheet material feeding direction (in the direction indicated by an arrow E in (b) of FIG. 6) by the urging force of the returning lever spring 24 shown in FIG. 3, and therefore, is retracted from the sheet material feeding path X ((c) of FIG. 6). At this time, a projection 14*a* of the returning lever controlling cam 14 is brought into contact to the flange portion 23*b* of the ASF control gear 23 to stop rotation of the returning lever control cam 14, by which the retracted position of the returning lever 13 is determined. In the state, the general structure is as shown in FIG. 8.

After the returning lever 13 is completely retracted from the sheet material feeding path X, the fixed of the pressure plate 16 is released so that pressure plate 16 is urged toward the feeding roller 11 by the pressure plate spring 19, by which the topmost sheet material of the state of the sheets thereon is press-contacted to the feeding roller 11. Upon the press contacting action, the sheet material feeding is started.

Thereafter, the sheet material is caught by the main assembly, the cooperative feeding with the feeding roller 11 begins, and the feeding operation goes into a double feed preventing operation mode in which the pressure plate 16 is moved away from the feeding roller 11. When the pressure plate 16 is moved away, the topmost sheet material is released from the press-contact to the feeding roller 11, and therefore, the feeding force imparted to the sheet material reduces. In addition, immediately thereafter, the cut surface 11*a* of the feeding roller 11 starts to face to the pressure plate portion. However, the separation roller 12 and the feeding roller 11 are still press-contacted to each other, the feeding action still continues. The feeding action of the feeding roller 11 continues. As shown in (d) of FIG. 6, when the ASF control gear 23 rotates through a predetermined degree from the state shown in (a) of FIG. 6, the cam 23*a* of the ASF control gear 23 rotates the cam follower portion 14*b* of the returning lever control cam 14 in the direction indicated by an arrow G in (d) of FIG. 6 and rotates the returning lever 13 in the direction indicated by an arrow F in (d) of FIG. 6).

Upon the start of rotation of the returning lever 13 in the direction indicated by the arrow F in (d) of FIG. 6, the separation roller control cam 27 is driven by unshown cam provided on the side of the ASF control gear 23 opposite the side provided with the cam 23*a*. By the operation of the separation roller control cam 27, the separation roller 12 having the torque limiter 12*a* is moved away from the feeding roller 11 against the urging force of the separation roller urging spring 25. By this, the press-contact force of the separation roller 12 to the feeding roller 11 disappears so that sheet material is no longer retained by the sheet material feeding device. However, the sheet material is caught by the main assembly.

At the time when the sheet material is not retained by the device, the free end of the returning lever 13 starts to enter the sheet material feeding path X to hold the leading edge or leading edges of the next sheet or sheets having entered the separation portion and to return the leading edge or edges to the sheet material free end portion or leading end portion reference 15*b*. By this, the state returns to the shown in (a) of FIG. 6 and FIG. 7. In this manner, the returning lever 13 prevents the next sheet materials from lowering with the feeding of the topmost sheet material.

In FIG. 5, the track of the leading end 13*a* of the returning lever is shown in the general arrangement. When the separation roller 12 having the torque limiter is brought out of contact relative to the feeding roller 11, the free end portion 13*a* of the returning lever 13 enters the feeding path of the topmost sheet material remaining in the sheet material feeding device.

After the feeding roller 11 rotates one full turn while the leading end of the fed sheet material is gripped by the main assembly, and then stops, the cut surface 11*a* of the feeding roller 11 faces to the separation roller 12 having the torque limiter to provide the gap therebetween, and therefore, during the feeding of the sheet material by the main assembly with the process of the printing operation, the latter part of the sheet material simply passes through the gap.

In the foregoing, the description has been made as to the case in which the stacked sheet materials are fed out from the topmost sheet one by one. However, the present invention is applicable irrespective of the whether the topmost or bottommost sheet material is fed out, if the sheet is the first sheet coming to the separation portion.

The sheet material feeding device of the present invention is connectable with a recording apparatus, an image forming apparatus, an image reading apparatus or the like such as a printer, a copying machine, a printing apparatus, a facsimile, a scanner or the like. What is fed by the sheet material feeding device of the present invention is not limited to the sheets, but it may be an OHP sheet or the like. The sheet material feeding device is suitably applicable to a recording apparatus with which the printing operation is carried out while feeding the sheet material with high precision, and particularly an ink jet recording apparatus which prints on various materials by ejecting the liquid (ink) through a nozzle to deposit it on the materials.

As described in the foregoing, according to the present invention, a first sheet material of the stack of the sheets is fed from the stack by rotation of a feeding rotatable member into between the feeding rotatable member and the rotatable member having a torque limiter without a driving source, the rotatable member having the torque limiter being urged to the feeding rotatable member. By this, the double feeding can be easily prevented without such a complicated mechanism as with the retarding roller type and without bulkiness or expensiveness.

By the actuation of the returning lever during the feeding operation for the sheet material by one direction and one rotation control of the feeding rotatable member, no complicated control is required, and the feeding operation time related with the double feeding prevention can be shortened.

In another aspect of the present invention, the center of rotation of the separation roller holder for holding the separation roller is positioned adjacent an extension line of an orbit of the sheet material abutting to the outer periphery of the separation roller, and the line connecting the center of rotation 26*a* and the rotational axis of the separation roller 12 is parallel with a tangent line of the feeding roller 11 passing through the nip between the feeding roller and the separation roller. By this, the sheet materials can be stably and smoothly separated with a stabilized separation pressure.

While the invention has been described with reference to the structures disclosed herein, it is not confined to the details set forth and this application is intended to cover such modifications or changes as may come within the purposes of the improvements or the scope of the following claims.

What is claimed is:

1. A sheet material feeding device comprising:

a sheet material stacking means for stacking sheet materials;

a feeding roller for feeding the sheet material stacked on said sheet material stacking means;

a separation roller, driven by said feeding roller, for separating a sheet material from the sheet materials;

a separation roller holder for rotatably holding said separation roller, said separation roller holder being movable by rotation thereof between a position in which said separation roller is contacted to said feeding roller and a position in which said separation roller is away from said feeding roller; and returning means for returning a sheet material or sheet materials other than the sheet material separated out by said separation roller to said sheet material stacking means, the returning occurring as the sheet separated out by said separation roller passes between said feeding roller and said separation roller, wherein said returning means starts its operation in a condition where said feeding roller and said separation roller are in contact with each other, and after a start of the operation of said returning means, said separation roller is moved away from said feeding roller.

2. A device according to claim 1, wherein said separation roller is provided with a torque limiter.

3. A device according to claim 1, further comprising urging means for press-contacting said separation roller to said feeding roller.

4. A device according to claim 1, wherein said separation roller is contacted to said feeding roller at a position downstream of a position where said feeding roller is contacted to the sheet material stacking means.

5. A device according to claim 1, wherein a center of rotation of said separation roller holder is substantially on an extension line of orbit of advancement of the sheet material fed by said feeding roller toward an outer surface of said separation roller.

6. A device according to claim 5, wherein when said separation roller is contacted to said feeding roller, a line connecting a center of rotation of said separation roller holder and a center axis of said separation roller is substantially parallel with a tangent line of a feeding roller passing the nip formed between said feeding roller and said separation roller.

7. A device according to claim 1, wherein said sheet material stacking means is movable toward and away from said feeding roller.

8. A device according to claim 1, wherein said sheet material stacking means stacks the sheet materials at an angle of 30°–90° relative to a horizontal plane.

9. A recording apparatus for effecting recording on a sheet material using a recording head, comprising:

a head carrying portion for carrying the recording head;

sheet material stacking means for stacking sheet materials;

a feeding roller for feeding the sheet material stacked on said sheet material stacking means, a separation roller, driven by said feeding roller, for separating a sheet material from the sheet materials;

a separation roller holder for rotatably holding said separation roller, said separation roller holder being movable by rotation thereof between a position in which said separation roller is contacted to said feeding roller and a position in which said separation roller is away from said feeding roller; and returning means for returning a sheet material or sheet materials other than the sheet material separated out by said separation roller to said sheet material stacking means, the returning occurring as the sheet separated out by said separation roller passes between said feeding roller and said separation roller, wherein said returning means starts its operation in a condition where said feeding roller and said separation roller are in contact with each other, and after a start of the operation of said returning means, said separation roller is moved away from said feeding roller.

10. An apparatus according to claim 9, wherein said separation roller is provided with a torque limiter.

11. An apparatus according to claim 9, further comprising urging means for press-contacting said separation roller to said feeding roller.

12. An apparatus according to claim 9, wherein said separation roller is contacted to said feeding roller at a position downstream of a position where said feeding roller is contacted to the sheet material stacking means.

13. An apparatus according to claim 9, wherein a center of rotation of said separation roller holder is substantially on an extension line of orbit of advancement of the sheet material fed by said feeding roller toward an outer surface of said separation roller.

14. An apparatus according to claim 13, wherein when said separation roller is contacted to said feeding roller, a line connecting a center of rotation of said separation roller holder and a center axis of said separation roller is substantially parallel with a tangent line of a feeding roller passing the nip formed between said feeding roller and said separation roller.

15. An apparatus according to claim 9, wherein said sheet material stacking means is movable toward and away from said feeding roller.

16. An apparatus according to claim 9, wherein said sheet material stacking means stacks the sheet materials at an angle of 30°–90° relative to a horizontal plane.

* * * * *

UNITED STATES PATENT AND TRADEMARK OFFICE

CERTIFICATE OF CORRECTION

PATENT NO. : 6,824,132 B2
DATED : November 30, 2004
INVENTOR(S) : Yasuyuki Asai et al.

It is certified that error appears in the above-identified patent and that said Letters Patent is hereby corrected as shown below:

Title page,
Item [56], References Cited, FOREIGN PATENT DOCUMENTS, "04164723" should read -- 04-164723 --.

Column 1,
Lines 36 and 46, "returns" should read -- return --.

Column 2,
Line 57, "a" should be deleted.

Column 3,
Line 42, "positioning a" should read -- positioning --.
Line 48, "a" should be deleted.
Line 65, "by" should read -- by being --.

Column 5,
Line 45, "rotates." should read -- rotate. --.

Column 9,
Line 13, "of the" should read -- of --.
Line 62, "a" should be deleted.

Column 10,
Line 50, "means," should read -- means; --.

Signed and Sealed this

Twenty-second Day of March, 2005

JON W. DUDAS
*Director of the United States Patent and Trademark Office*